United States Patent [19]

Kinsey

[11] Patent Number: 4,675,681

[45] Date of Patent: Jun. 23, 1987

[54] ROTATING PLANAR ARRAY ANTENNA

[75] Inventor: Richard R. Kinsey, Dewitt, N.Y.

[73] Assignee: General Electric Company, Syracuse, N.Y.

[21] Appl. No.: 766,341

[22] Filed: Aug. 16, 1985

Related U.S. Application Data

[63] Continuation of Ser. No. 425,372, Sep. 28, 1982.

[51] Int. Cl.[4] ..... H01Q 3/22; H01Q 3/24; H01Q 3/26

[52] U.S. Cl. ..... 342/372; 343/771; 343/778

[58] Field of Search ..... 343/371, 372, 771, 778, 343/768, 844

[56] References Cited

U.S. PATENT DOCUMENTS

| | | | |
|---|---|---|---|
| 2,940,075 | 6/1960 | Stavis et al. . | |
| 2,967,301 | 1/1961 | Rearwin | 343/771 |
| 3,078,463 | 2/1963 | Lamy | 343/771 |
| 3,281,851 | 10/1966 | Goebels, Jr. | 343/768 |
| 3,286,260 | 11/1966 | Howard . | |
| 3,434,139 | 3/1969 | Algeo | 343/778 |
| 3,471,857 | 10/1969 | Schwartz | 343/371 |
| 3,508,275 | 4/1970 | Deveau et al. | 343/371 |
| 3,518,689 | 6/1970 | Algeo et al. | 343/778 |
| 4,041,501 | 8/1977 | Frazita et al. | 343/844 |

OTHER PUBLICATIONS

F. J. Goebels et al, Four Independent Beams from a Single Linear Array, IEEE Trans. on Attennas and Propagation, Vol. AP-13, pp. 683-691, Sep. 1965.

J. R. Miller et al, A Planar Slot Array with Four Independent Beams, IEEE Trans. on Antenna and Propagation, vol. AP-14, No. 5, pp. 560-566, Sep. 1966.

L. Stark, Comparison of Array Element Types, Proceedings of the 1970 Phased Array Antenna Symposium, Jun. 1970, pp. 51-66.

*Primary Examiner*—Theodore M. Blum

*Attorney, Agent, or Firm*—Carl W. Baker; Richard V. Lang

[57] ABSTRACT

A planar array antenna is contructed of two sets of slotted rectangular waveguides positioned to have the slots of adjacent waveguides offset by half the slot spacing. A bidirectional feed is used with phase switching between inputs to produce four distinct output beams from the array.

18 Claims, 13 Drawing Figures

ROTATING PLANAR ARRAY ANTENNA

The U.S. Government has rights in this invention pursuant to contract number N60921-79-C-A235 awarded by the U.S. Navy.

This application is a continuation of copending application Ser. No. 425,372, filed Sept. 28, 1982 by the present inventor and assigned to the same assignee.

BACKGROUND OF THE INVENTION

1. Field of the Invention

This invention relates to rotating planar array antennas, and more particularly, to an antenna construction able to obtain a high data rate.

2. Description of the Prior Art

Prior art radar systems have employed two-dimensional scanning, i.e., scanning in elevation and azimuth to obtain the desired scan coverage. For example, U.S. Pat. No. 3,434,139 issued Mar. 9, 1969 to J. A. Algeo, and U.S. Pat. No. 3,518,689 issued June 30, 1970 to J. A. Algeo et al, both assigned to North American Rockwell Corporation, disclose radar systems employing a serpentine feed for each row of radiating elements and a serpentine feed for each column of radiating elements arranged in a linear array. A two-dimensional scan is achieved by controlling the frequency of the inputs to the two serpentine feeds. This feed structure results in a heavy, bulky construction and provides only a single unambiguous beam, which limits the data rate for the antenna system. In another prior art system disclosed in U.S. Pat. No. 4,041,501, issued Aug. 9, 1977 to Frazita et al and assigned to Hazeltine Corporation, a plurality of phase shifters is employed to provide an output signal having a desired wave form. This array configuration uses a plurality of feed elements connected to the antenna elements by directional couplers to produce a single unambiguous beam, which limits the maximum available data rate.

For edge slotted waveguide rows in a conventional single beam antenna, the slot spacing is approximately one-half the guide wavelength, and the slots are alternately tilted in opposite directions relative to the antenna centerline. This introduces a 180 degree phase compensation and steers the beam close to broadside. However, it also means that the cross-polarization (vertical) components alternate in phase relative to the principal polarization (horizontal) components. The result is that cross-polarization lobes peak up off axis on the diagonal planes, resulting in a substantial peak sidelobe.

SUMMARY OF THE INVENTION

Accordingly, an object of the present invention is to provide a high data rate from an antenna rotating in azimuth at a relatively slow speed. A more specific object of the present invention is to provide a lightweight slotted waveguide constructuion and a bidirectional feed arrangement for a planar array so that a plurality of beams can be output simultaneously from the antenna and scanned in elevation during rotation of the planar antenna in azimuth.

The present invention includes a bidirectionally fed antenna having: a plurality of slotted waveguides disposed in parallel relationship and so arranged that the slots of adjacent waveguides form a triangular lattice structure; bidirectional feed means for supplying input signals to each of the opposite ends of each of said waveguides; and switching means for phase switching input signals between adjacent waveguides to produce a plurality of distinct output beams each radiating in a distinct direction from said planar array antenna.

BRIEF DESCRIPTION OF THE DRAWINGS

Features of the invention believed to be novel and unobvious over the prior art are set forth with particularly in the appended claims. The invention itself; however, as to organization, method of operation and best mode contemplated by the inventor, will best be understood by reference to the following description taken in conjunction with the accompanying drawings, in which like reference characters refer to like elements throughout, and in which;

DESCRIPTION OF THE PREFERRED EMBODIMENTS

Figure 1:
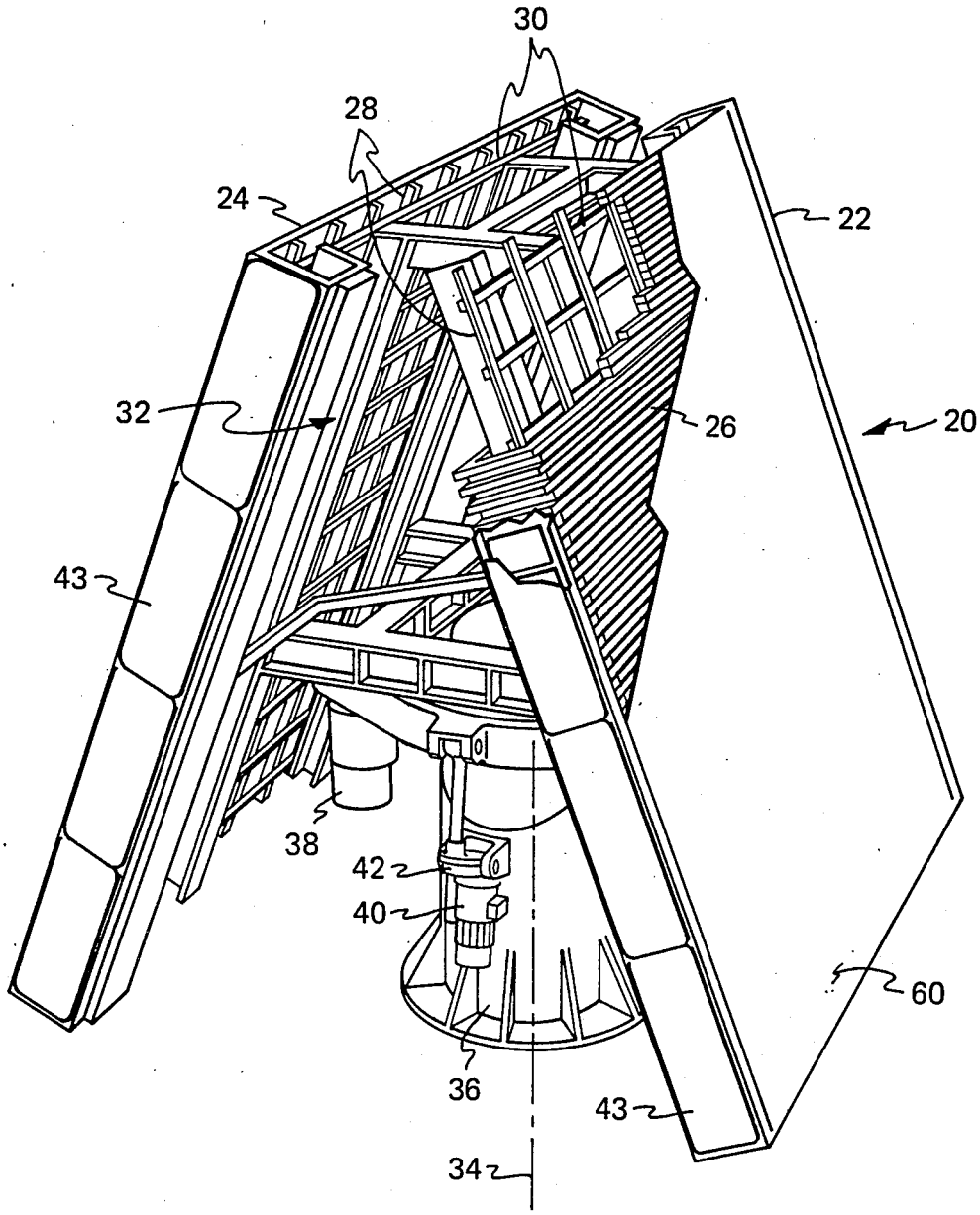
FIG. 1 is an oblique view of a planar array antenna built according to the present invention.

FIG. 1 illustrates one face of a dual face FAST (Flanking-beam Array Switching Technique) antenna system of the type for use, for example, on ships. The antenna 20 comprises a pair of arrays 22, 24 each having a plurality of waveguides 26 arranged in parallel fashion and extending generally horizontally. Each array is made up of a plurality of slotted waveguides, preferably made of rectangular, thin walled aluminum waveguide. The waveguides may be supported by a grid of vertical 28 and horizontal 30 rectangular structural tubes. The waveguides are mechanically fastened to the vertical tubes 28 which are supported by the horizontal tubes 30. The horizontal tubes are mounted upon a lightweight, but rugged dual A-frame structure 32 fabricated from structural aluminum I-beams. The construction of the frame is designed to minimize array deflections and material stresses produced by antenna movement with ship's roll and wind loads. Each array is shown mounted in a tiltback angle of approximately 20 degrees relative to the vertical axis 34 of the support structure 32. This tiltback angle may be chosen at any angle from 0 to 90 degrees determined by the desired beam pattern and mechanical support system. An azimuth motor 38 is mounted upon the support structure to drive the antenna in azimuthal rotation. Roll motors, one of which is shown at 40, stabilize the antenna about the roll axis which is perpendicular to axis 34, by controlling the ballscrew assembly 42, using roll position signals provided from the ship's gyro repeater (not shown). A housing 43 provides environmental protection for the antenna components located at each end of each array.

Figure 2A:
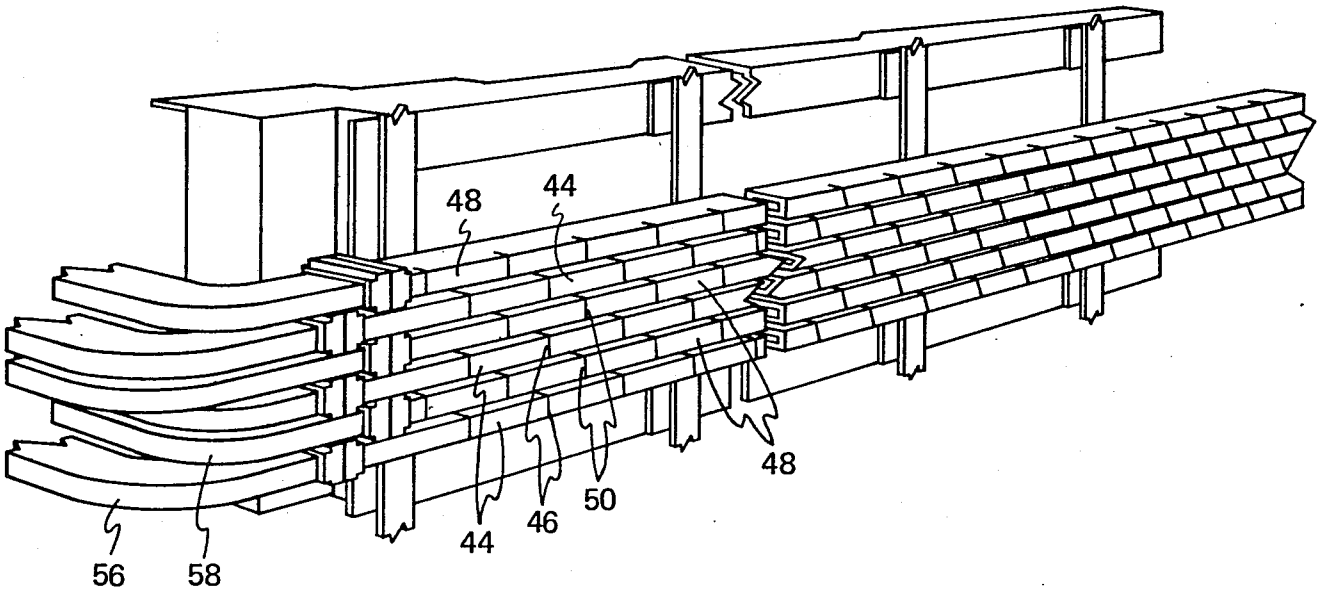
FIGS. 2A and 2B are schematic pictorial views of waveguide elements illustrating details of the planar array antenna of the present invention.
Figure 2B:
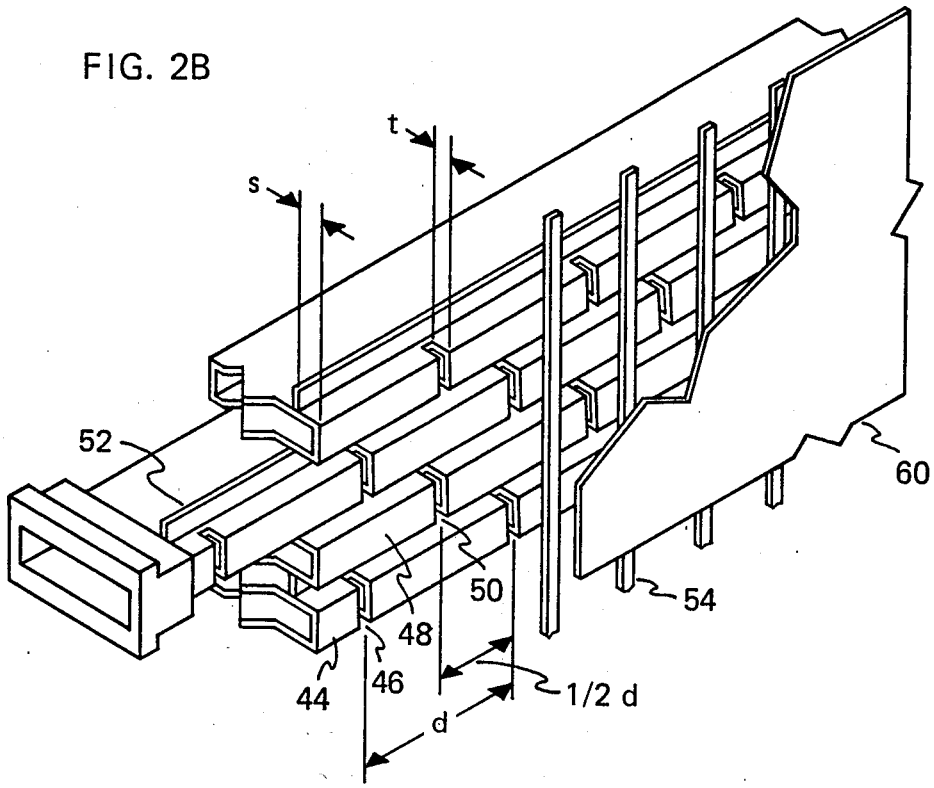

FIGS. 2A and 2B illustrate the preferred arrangement of the waveguides employed in the antenna of the present invention. A first set of waveguides 44 is disposed in spaced relationship upon the grid, such that the slots 46 of each waveguide 44 are vertically aligned with the slots of the other waveguides 44. Interleaved with the first set of waveguides is a second set of waveguides 48 disposed upon the grid such that the slots 50 of each waveguide 48 are in vertical alignment and are offset from the slots 46 of the interleaved adjacent waveguides 44 by one-half the slot spacing d. The slots of each of waveguides 44 and 46 are uniformly spaced by the same distance d, thereby producing a triangular lattice of slots at each array face. A conductive member 52 is disposed between adjacent waveguides to form a trough approximately one-quarter wavelength deep. This is necessitated by the fact that all the edge slots are cut back into the waveguide broadwall. In order to suppress the undesired trough modes, conductive strips 54 of, for example, copper are disposed in generally parallel vertical orientation between adjacent ones of the slots and perpendicular to the longitudinal axes of the waveguides. The trough depth s is greater than t, the depth of the slot cut-back. The end waveguides 56, 58 are designed to provide an equivalent path length to the phase shifters for each of the waveguides. A radome 60 comprising a planar sheet of epoxy glass or a similar material resistant to weather damage and transparent to the rf signals transmitted by the antenna is attached to the aperture face.

The waveguides are disposed such that the edge slots of each waveguide tilt in the same direction relative to the vertical axis as those of the other waveguides. The degree of tilt of the slots increases toward the center of the array, and slots approximately equidistant from the center of each waveguide have approximately the same tilt angle. This results in the cross-polarization (vertical) components having the same phase relationships as the main-polarization (horizontal) components which eliminates the usual problem of cross-polarization lobes peaking up off-axis. Moreover, the cross-polarization excitation has a greater amplitude taper than the main-polarization, so that any cross-polarized sidelobes would inherently be suppressed to a very low level and fall off rapidly with angle from the main beam. Conceptually, linear polarization of the main lobe is tilted several degrees from horizontal. However, in practice, there is no measurable tilt, because the cross-polarized components are suppressed by the trough between waveguides.

Figure 3:
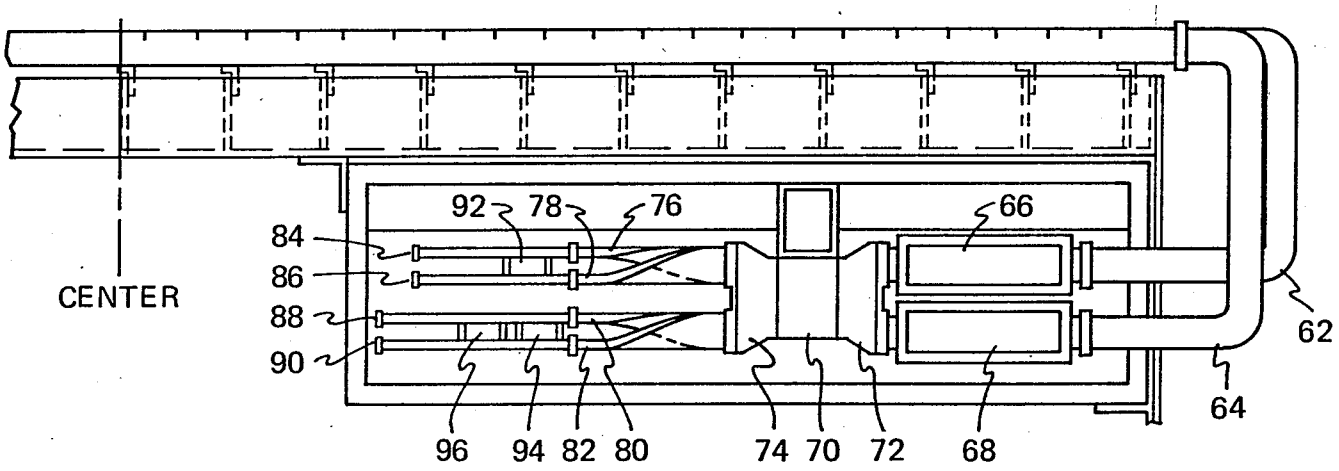
FIG. 3 is a schematic partial pictorial view of the signal feed arrangement used for feeding signal to the individual waveguides of the present invention.

FIG. 3 illustrates the feed arrangement for the waveguides 44 and 48. An offset 62 connected to an end waveguide 58 and an offset 64 connected to an end waveguide 56 are connected respectively to ferrite phase shifters 66, 68. Each of the phase shifters 66, 68 is connected to 3 dB hybrid coupler 70 by adapter 72. Adapter 74 connects hybrid coupler 70 to two of four 90 degree twists 76, 78, 80, 82 which are connected to respective cross-guide coupler sections 84, 86, 88, 90. Coupler sections 84 and 86 are coupled to a transmit column 92, and coupler sections 88 and 90 are coupled to receive columns 94, 96. The transmit column 92 and the receive columns 94, 96 are connected to excitation and signal processing circuits (not shown). Coupler sections 84, 86, 88, 90 are terminated in matched loads. Similar equipment is connected to the opposite ends of the respective slotted row-waveguides so that the system may be fed from either end.

Figure 4:
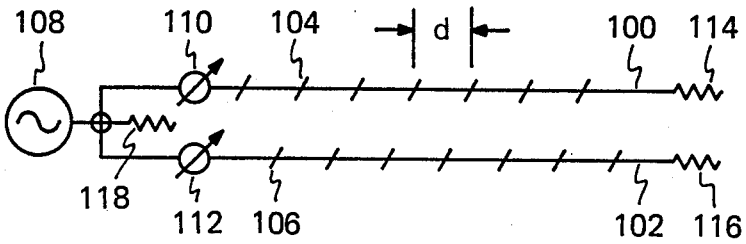
FIG. 4 is a schematic circuit diagram illustrating a staggered row pair forming a triangular element lattice fed from one end.

The operation of an antenna of the present invention will now be described. The design of a travelling wave bidirectional array is uniquely different from that of a unidirectional array. The slot conductances must be symmetrical about the center of the array and are determined by the number of slot elements, the desired side lobe level, the ohmic losses in the slotted waveguide and fractional power remaining at the end of the line. A unidirectional feed arrangement is schematically illustrated in FIG. 4. A pair of adjacent waveguides 100, 102 are shown schematically as having slots 104, 106, respectively, offset by one-half the slot spacing d. An excitation source 108 is connected to the left end of each of the waveguides and coupled through phase shifters 110, 112 to supply phase controlled power to each of the respective waveguides. The waveguides are terminated in loads 114, 116, which will absorb the residual power not radiated by the slotted waveguides when excited by source 108.

Figure 5:
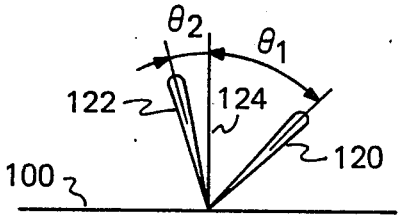
FIG. 5 is a plot of a pair of output beams produced by a single row of waveguides excited as illustrated in FIG. 4.

The two beams 120, 122 shown in FIG. 5 can be formed simultaneously from one slotted waveguide 100 when excited from one end, and these beams will be related to the feed design parameters as determined by the expressions for the beams produced. The expression for beam pointing, along the (horizontal) U-axis of T-space, in which $\lambda_g$ equals the guide wavelength, $\lambda$ equals the free space wavelength, d equals the slot spacing, and i is an arbitrary integer multiplier, is:

$$U = \sin\theta\cos\phi = \frac{\lambda}{\lambda_g} + i\frac{\lambda}{d}\,;\ i = 0, \pm 1, \pm 2\ldots \tag{1}$$

$$U_1 = \frac{\lambda}{\lambda_g} \text{ for } i = 0 \tag{2}$$

$$U_2 = \frac{\lambda}{\lambda_d} = \frac{\lambda}{d} \text{ for } i = -1. \tag{3}$$

Since two beams are desired, a third beam in visible space would be ambiguous. To prevent the formation of a grating lobe in visible space, which would represent the ambiguous third beam, requires that $$U = \frac{\lambda}{\lambda_g} + i\frac{\lambda}{d} < -1 \text{ for all } i \leqq -2, \text{ and} \tag{4}$$

$$\frac{\lambda}{\lambda} + i\frac{\lambda}{d} > +1 \text{ for all } i \geqq 1 \tag{5}$$

Beam pointing along the V-axis of T-space is determined by a linear phase gradient introduced by the row phase shifters. The relation to coordinate angles is given by:

$$V = \sin\theta\sin\phi \tag{6}$$

Switching between the two beams is also accomplished by controlling the relative phasing between adjacent rows of a row pair of give phase addition of one beam and phase cancellation of the other.

Figure 6:
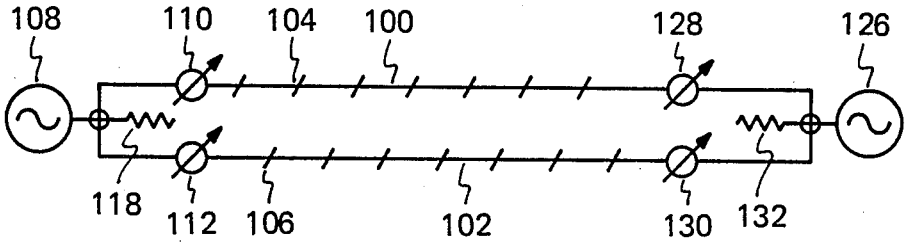
FIG. 6 is a schematic circuit diagram illustrating a bidirectionally fed, staggered row pair of waveguides of the present invention.
Figure 7:
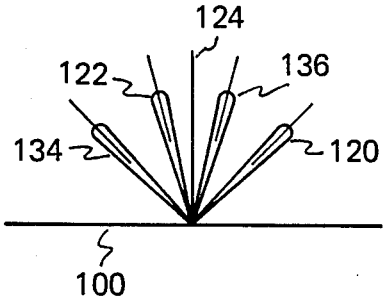
FIG. 7 is a plot of the output beams produced by a single row of waveguides excited as illustrated in FIG. 6.

The bidirectional feed of the present invention is shown schematically in FIG. 6. An excitation source 126 is coupled through phase shifters 128, 130 to waveguides 100, 102, respectively, and is connected to hybrid load 132. Using the bidirectional feed, excitation source 126 will produce a pair of beams 134, 136 at the mirror image positions of the beams 120, 122 produced by source 108 for a total of four possible flanking beams for each array aperture as shown in FIG. 7. Equations 1 through 6, above, apply to the beams produced by each excitation source. In addition to switching between the two beams, each of the beams is electronically scanned in elevation by computer control of the phase shifters to provide surveillance of an area from 0 to 60 degrees or more in elevation with each rotation of the aperture.

The objective of array design is to choose the slot spacing d so that an outer flanking beam, e.g., 120 on one side, as shown in FIG. 7, or an inner flanking beam, e.g., 122 on the other side, can be supplied by one input 108 by switching between the proper settings the phase shifters 110, 112. The waveguides are so constructed that the feedline mismatches due to the slots tend to cancel assuring a low-VSWR (Voltage-Standing-Wave-Ratio) at the inputs. Coupling co-efficients are symmetric about the array center, so that the radiation patterns produced by feeding one end are the mirror images of the patterns produced by feeding the other end. The sources 108 and 126 could be separately combined in column feed networks with appropriate connection circuits between the feeds and the waveguides to form the two antenna radiation patterns without requiring separate excitation sources. The phase shifters are used to compensate for manufacturing tolerances to correct for path length errors in the waveguide rows. Six-bit phase shifters are preferred in the present invention with steering commands provided by a beam steering computer. The computer stores error compensation requirements measured at the time of waveguide manufacture along with the predetermined beam control requirements which are used as inputs to calculate the phase adjustment to be transmitted to each phase shifter for each output pulse. The computer thereby controls the sequence and beam pattern position emitted by each array as the antenna is rotated.

From equations 2 and 3, above, it can be seen that the outer flanking beam position ($U_1$) is determined by the choice of internal waveguide width for a given frequency, since $\lambda_g$, the guide wavelength, is dependent upon the internal waveguide dimensions, while the inner flanking beam position ($U_2$) is controlled by the slot spacing d. To achieve uniform spacing of the beams an attractive choice for slot spacing d is three-fourths of the guide wavelength at the design frequency. For an outer flanking beam positioned near 45 degrees with respect to broadside position 124, as 120 or 134 in FIG. 7, the inner flanking beam 122, 136, respectively, will be positioned at about 14 degrees. If two flanking beams are separated by about 90 degrees for a planar array, e.g., as 120 and 134 of FIG. 7, and two arrays are mounted back-to-back, a 4-to-1 increase in data rate over that available from a single beam antenna can be obtained for each rotation of the antenna. However, elevation scanning of these beams is limited to about 40 degrees as they scan along a minor circle (cone) rather than a great circle. Furthermore, the aperture gain is down 1.5 to 2 db because of the reduction in projected aperture. For these reasons, a broadside beam or pair of beams near broadside are desired in addition to the wide angle azimuth beams. As shown in FIG. 7, the present invention provides the capability to produce this pair of flanking beams 122, 136 near broadside and the pair of wide angle flanking beams 120, 134 to provide improved data rate and projected aperture.

Figure 8:
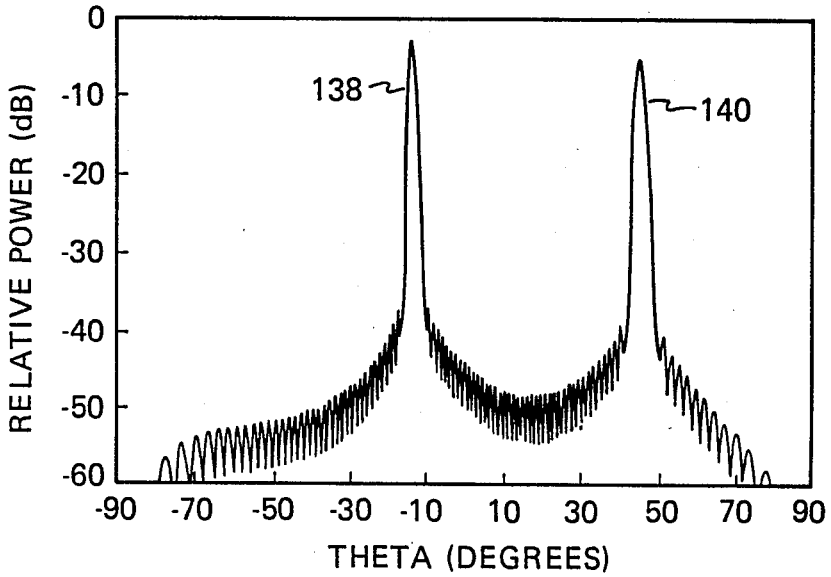
FIG. 8 is a plot of the two flanking beams produced by a single row of radiating elements fed at one end.

FIG. 8 is a plot of the two flanking beams 138, 140 produced in a test of a single row of elements designed according to the present invention with slot spacing d of $\frac{3}{4}\lambda_g$ at the design frequency. The spacing $\frac{3}{4}\lambda_g$ corresponds to slightly more than one free-space wavelength, and the far-field pattern will therefore exhibit two beams as shown in FIG. 8. Note that the amplitude of the right flanking beam 140 is below that of the left flanking beam because of the element pattern. Further, the amplitude of both beams is below maximum, because the power is divided between them. The near-in sidelobe level is designed to be about 34 dB below the beam peaks and it appears to be about at that level relative to each beam.

Figure 9:
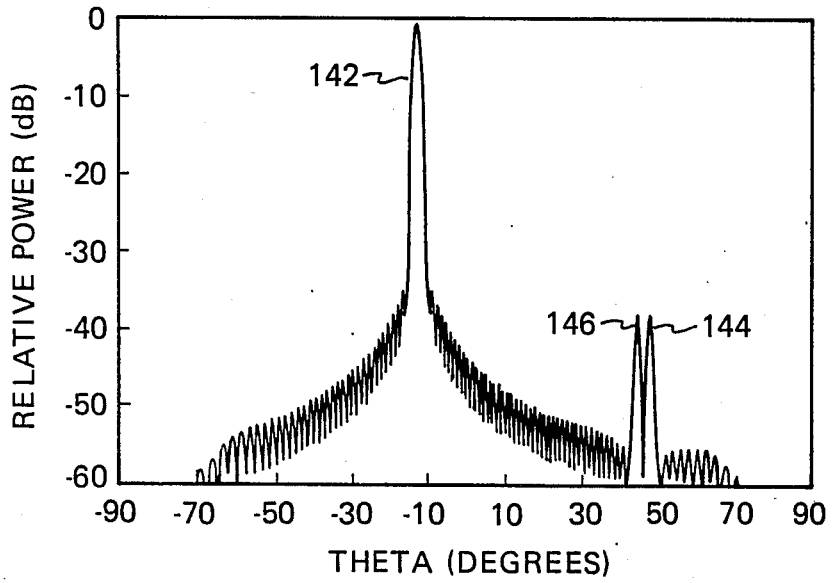
FIG. 9 is a plot of the beams produced by adjacent slotted waveguide rows fed out of phase.
Figure 10:
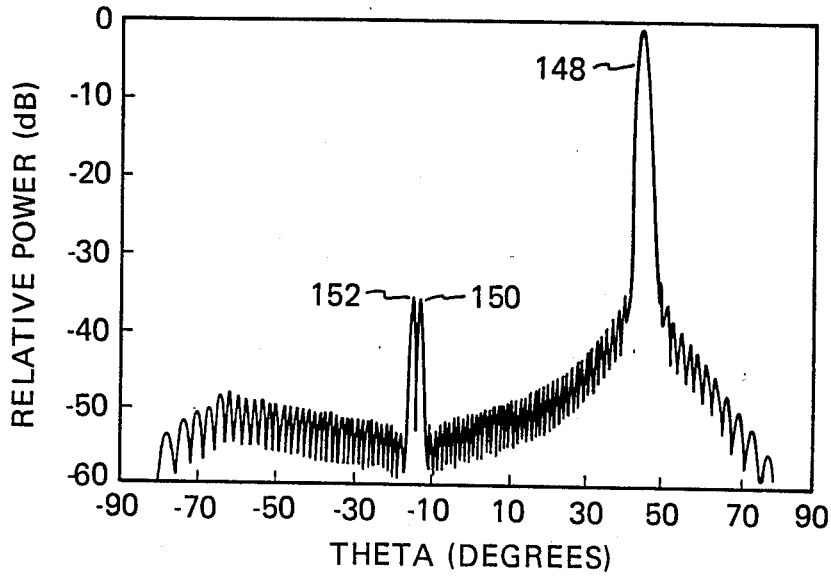
FIG. 10 is a plot of the beams produced by adjacent slotted waveguide rows fed in phase.
Figure 11:
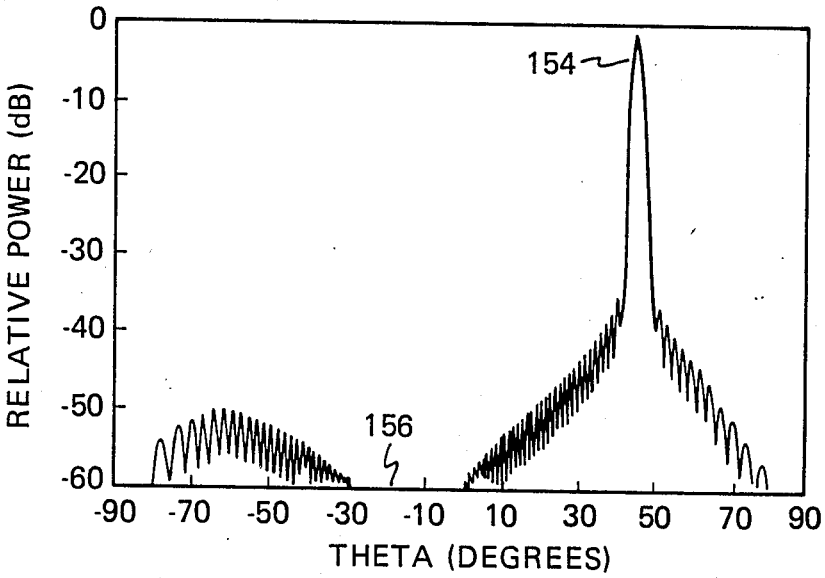
FIG. 11 is a plot of the beam pattern produced as in FIG. 10 except that alternate rows are staggered alternately to the right and left of the array center line.

If the desired $\frac{1}{2}$ d offset between elements in adjacent rows of the array were achieved by shifting the slots 50 in all of the waveguides 48 in the same direction relative to the slots 46 in waveguides 44, while retaining an identical number of slots in all rows of the array, the beam produced by the antenna could be switched by the phase shifters to provide the patterns shown in FIGS. 9 and 10. In FIG. 9 a beam 142 at the desired angle is produced along with a pair of sidelobes 144, 146 near the unwanted beam position, resulting from the fact that the two adjacent rows have phase centers separated by one-half the slot spacing, causing the centers not to coincide. In FIG. 10 a second beam 148 at the desired angle is shown along with a pair of sidelobes 150, 152 near the unwanted beam position. This can be corrected by shifting the slots 50 of successive waveguides 48 in opposite directions, alternating to the right and left by $\frac{1}{2}$ d so as to define a slot pattern which repeats every four rows of the array as shown in FIG. 2A. The result is that the effective phase centers of each adjacent pair of waveguides 48 are equally and oppositely displaced with respect to the array center and the residual lobes will tend to cancel. This produces the radiation pattern illustrated in FIG. 11, having a beam 154 at the desired position and complete cancellation at the principal plane position 156 of the residual lobes. Each array of waveguides will produce a beam pattern as shown in FIG. 11 for each feed direction, so that with the arrangement of FIG. 2A having waveguides 44 and 48 having bidirectional feed connections four beams will be produced from each array.

Figure 12:
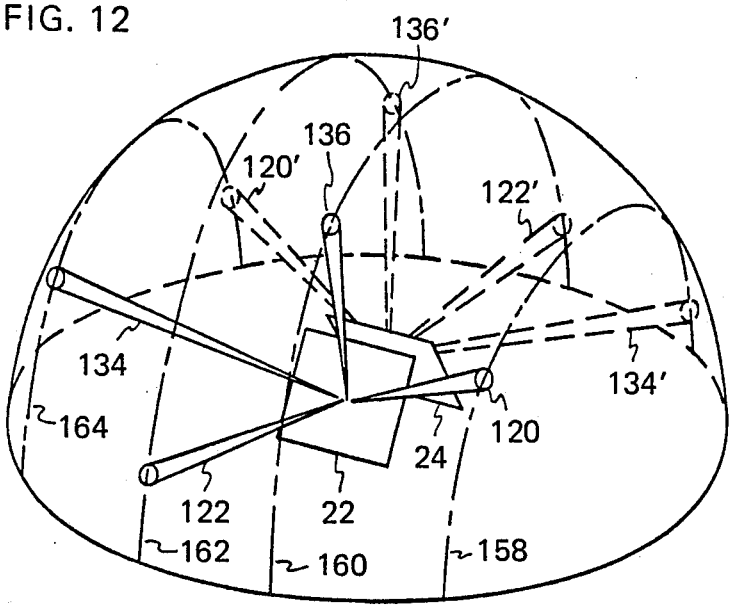
FIG. 12 is a schematic pictorial view illustrating the multibeam high data-rate rotating antenna of the present invention with a beam pattern produced thereby.

FIG. 12 illustrates the beams produced by the back-to-back arrays 22, 24 of the present invention. By using back-to-back arrays as described, the antenna transmits eight possible flanking beams 120, 122, 134, 136, 120, 122, 134, 136, providing a significantly increased data rate as compared to the data rate obtainable with a single pencil beam antenna rotating at the same rate. As the frequency of the excitation source is varied, the beams scan slightly in the U-plane as determined by Equations (2) and (3). Note that the two sets of beams obtained by feeding the two ends of the array scan in opposite directions with frequency, and the outer flanking beams are less frequency sensitive than the inner flanking beams. With four beams from each array 22, 24 the data rate and angular coverage is four times the rate achievable by a back-to-back arrangement providing a single beam from each array. The number and design parameters of waveguides in each array can be selected to accommodate the particular system with which the antenna is to be used, with antenna weight and power required representing significant design considerations. Table I lists the array design parameters for a particular proposed example of the present invention.

TABLE I

| | |
|---|---|
| Frequency Band: | 3.32 GHz +/− 5% |
| Aperture Size (active): | 177.7" H × 181.9" W |
| Elements/row: | 48 |
| Number of rows: | 168 |
| Number of array elements | 8064 |
| Waveguide I.D.: | 2.528" × 0.600" |
| Power Gain: | 40.0 dB |
| Design SLL: | −35 dB |
| Azimuth HPBW: | 25.3 ms (1.45 deg. broadside) |
| Elevation HPBS: | 23.7 ms (1.36 deg. broadside) |
| Number of phasers: | 336 |

Using aluminum waveguide having a wall thickness of 0.05 inch, the arrays described above will weigh approximately 975 pounds each. The light weight and high data rate of the antenna of the present invention provide an attractive antenna design for shipboard applications.

I claim:

1. A radar antenna comprising:

a plurality of elongated rectangular waveguides disposed in parallel relationship having uniformly spaced slots in one edge thereof and having one planar edge of each of said waveguides aligned to form a planar array; adjacent ones of said waveguides being disposed such that said slots of a first waveguide are offset from the slots of an adjacent waveguide;

bidirectional feed means for supplying input signals from the opposite ends of each of said waveguides; and switching means for phase switching input signals supplied to said adjacent waveguides by said bidirectional feed means to produce four distinct output beams from said planar array.

2. The invention of claim 1 further comprising:

a conductive ground plane disposed between each adjacent pair of waveguides.

3. The invention of claim 2 wherein:

said bidirectional feed means comprises:

a first excitation source;

a first plurality of phase shifters connected to said first source and to one end of a said plurality of waveguides;

a second excitation source; and a second plurality of phase shifters connected to said second source and to the other end of said plurality of waveguides.

4. The invention of claim 3 wherein said plurality of waveguides comprises:

a first set of waveguides interleaved with a second set of waveguides; each set of waveguides being positioned so that the slots of each waveguide in a set are in alignment with the slots of other waveguides of the same set and are offset by one-half the slot spacing from the slots of the waveguides of the other set.

5. The invention of claim 4 wherein:

the slots of each of said waveguides are tilted at predetermined angles of less than 45 degrees to the vertical axis of said array at the center of each of said waveguides;

successive ones of said slots are tilted at an angle relative to said vertical axis less than an adjacent inner slot; and the slots at the longitudinal ends of said waveguides being disposed approximately vertically.

6. The invention of claim 5 wherein a pair of said planar arrays is mounted upon a rotatable support structure, so that said arrays are tilted with respect to the axis of rotation of said support structure.

7. The invention of claim 6 wherein said slot spacing is about three-fourths of the guide-wavelength.

8. The invention of claim 7 wherein said ground plane members are set back from the face of said one edge by approximately one-quarter wavelength.

9. The invention of claim 8 further comprising:

a plurality of essentially vertically extending conductive strips disposed on the aligned edges of said waveguides to extend between the slots of the adjacent waveguides.

10. The invention of claim 9 further comprising:

a radome comprising a planar sheet of material transparent to electromagnetic radiation at the wavelength of said waveguides and covering said array and attached to said edges of said waveguides.

11. The invention of claim 10 wherein:

said waveguides comprise rectangular aluminum waveguides.

12. The invention of claim 11 wherein:

said conductive strips comprise flat copper conductors.

13. A method of transmitting radar signals comprising the steps of:

(a) supplying an excitation signal to a first set of phase shifters for exciting first and second pluralities of slotted waveguides arranged into a planar array having tilted offset slots therein from one end of said waveguides from a first source;

(b) controlling said first set of phase shifters to excite said first and second pluralities of slotted waveguides to produce one of a pair of beams of radiation from said excited end of said pluralities of waveguides;

(c) supplying an excitation signal to a second set of phase shifters for exciting said first and second pluralities of slotted waveguides from the end opposite said one end from a second source; and (d) controlling said second set of phase shifters to excite said first and second pluralities of slotted waveguides to produce one of a pair of beams of radiation from said excited end of said pluralities of waveguides.

14. The method of claim 13 further comprising:

(e) rotating said array to scan in an azimuthal direction.

15. The method of claim 14 wherein:

step (a) comprises:

(1) providing during a first predetermined sequence of time intervals a first signal from a first source to a first plurality of computer controlled phase shifters connected to one end of said first and second pluralities of waveguides; and (2) providing during a second predetermined sequence of time intervals a second signal from said first source to said first plurality of computer controlled phase shifters connected to said one end of said first and second pluralities of waveguides;

step (b) comprises:

(3) transmitting said first signal to said first and second pluralities of waveguides during said first predetermined sequence of time intervals; and (4) transmitting said second signal to said first and second pluralities of waveguides during said second predetermined sequence of time intervals; and step (c) comprises:

(5) providing during a third predetermined sequence of time intervals a third signal from a second source to a second plurality of computer controlled phase shifters connected to the opposite end of said first and second pluralities of waveguides; and (6) providing during a fourth predetermined sequence of time intervals a fourth signal from said second source to said second plurality of computer controlled phase shifters connected to said opposite end of said first and second pluralities of waveguides; and step (d) comprises:

(7) transmitting said third signal to said first and second pluralities of waveguides during said third predetermined sequence of time intervals; and (8) transmitting said fourth signal to said first and second pluralities of waveguides during said fourth predetermined sequence of time intervals.

16. The method of claim 15 wherein:

said first predetermined sequence of time intervals coincides with said third predetermined sequence of time intervals; and said second predetermined sequence of time intervals coincides with said fourth predetermined sequence of time intervals.

17. The method of claim 15 wherein:

said first predetermined sequence of time intervals coincides with said fourth predetermined sequence of time intervals; and said second predetermined sequence of time intervals coincides with said third predetermined sequence of time intervals.

18. The method of claim 15 wherein:

said first, second, third and fourth sequence of time intervals are successive.

* * * * *